United States Patent [19]

Salaman et al.

[11] Patent Number: 4,683,796

[45] Date of Patent: Aug. 4, 1987

[54] MOUTHPIECES FOR MUSICAL WIND INSTRUMENTS

[76] Inventors: William Salaman, 16, Ullswater Ave., Cardiff CF2 5PT; Bernard E. Richardson, 113 Bryn Pinwydden, Pennwyn, Cardiff CF2 7DG, both of United Kingdom

[21] Appl. No.: 845,695

[22] PCT Filed: Jul. 15, 1985

[86] PCT No.: PCT/GB85/00317

§ 371 Date: Mar. 12, 1986

§ 102(e) Date: Mar. 12, 1986

[87] PCT Pub. No.: WO86/00739

PCT Pub. Date: Jan. 30, 1986

[30] Foreign Application Priority Data

Jul. 13, 1984 [GB] United Kingdom ..... 8417885

[51] Int. Cl.[4] ..... G10D 7/02

[52] U.S. Cl. ..... 84/380 C; 84/383 R

[58] Field of Search ..... 84/330, 380 C, 383 R

[56] References Cited

U.S. PATENT DOCUMENTS

| | | | |
|---|---|---|---|
| 766,027 | 7/1904 | Fairchild | 84/330 X |
| 2,485,749 | 10/1949 | Ladd | 84/380 X |
| 3,722,348 | 3/1973 | Visser | 84/380 C |

FOREIGN PATENT DOCUMENTS

| | | | |
|---|---|---|---|
| 180467 | 5/1954 | German Democratic Rep. | 84/380 C |

*Primary Examiner*—Lawrence R. Franklin

*Attorney, Agent, or Firm*—Wood, Dalton, Phillips, Mason & Rowe

[57] ABSTRACT

A mouthpiece (1) for a musical wind instrument comprises an inlet (5), an outlet (6), a hollow chamber (7) for collecting liquid from inlet air, and an enclosed windway (2), in which is disposed in the mouthpiece and leads to the outlet (6), wherein the inlet (5) and the windway (2) are interconnected via the hollow chamber (7). In use, the player's breath passes through the hollow chamber (7), allowing liquid to collect in the chamber, and then through the windway (2) out of the mouthpiece. The moisture-reduced air prevents sound disturbance and can be used for a considerable time before cleaning out becomes necessary. Also, the flow can be constricted which reduces the likelihood of overblowing by inexperienced players.

7 Claims, 5 Drawing Figures

MOUTHPIECES FOR MUSICAL WIND INSTRUMENTS

The present invention relates to musical wind instruments having a mouthpiece, namely that portion of the instrument which is blown by the player, which is generally of a comfortable and visually attractive shape and includes a windway which assists in providing laminar flow into the body of the instrument.

A conventional recorder mouthpiece has a straight-through windway 2 as shown in FIG. 1. A player's breath passes along the windway and is split by a fipple 3, formed by the edge of an aperture 4 in the recorder body adjacent the mouthpiece 1, thereby producing fluctuations in the local air pressure which are resonantly amplified by the air column of the instrument's body to produce a musical sound.

After the recorder has been played for a few minutes, the player's breath condenses in the windway. This condensation, together with an accumulation of saliva in the windway tends to cause a blockage in the windway, resulting in a disturbance of the air jet impinging on the fipple. This disturbance of the air jet creates a distortion of the sound produced by the instrument when played.

This liquid can also pass into the recorder body. The liquid collected has to be frequently removed, which is awkward and unpleasant and may need to be done at an inconvenient time. The liquid can also deteriorate the inside of a wooden instrument after much use.

It is possible to alleviate such blockages by prewarming the mouthpiece, especially for wooden instruments. However, blockages tend to be worse in non-wooden instruments, such as the plastic instruments often played by children, who moreover are less inclined to spend time prewarming an instrument.

A modified recorder has a widened windway in an attempt to overcome these problems but this reduces resistance to the breath which causes poor tone and intonation, especially with inexperienced players.

It is, therefore, an object of this invention to overcome these drawbacks.

According to the invention, we propose a mouthpiece for a musical wind instrument, comprising an inlet, an outlet, a hollow chamber for collecting liquid from the inlet air, and an enclosed windway which is disposed in the mouthpiece and leads to the outlet, wherein the inlet and the windway are interconnected via the hollow chamber.

We also purpose a musical instrument having the aforesaid mouthpiece.

According to another aspect of the invention, we propose a method of reducing the occurence of blockage by liquid in a musical wind instrument, comprising passing inlet air through a hollow chamber in the mouthpiece, allowing liquid from the inlet air to collect in the hollow chamber and then guiding the moisture-reduced air along an enclosed windway out of the mouthpiece.

The windway is a straight-through passage for creating laminar flow onto the fipple in the recorder body, and is defined by a narrow tube, which may have rectangular or other cross-section. The windway extends along a part of or substantially the whole length of the mouthpiece to the mouthpiece outlet. The mouthpiece may have an inlet passage which assists in directing the air into the body of the chamber. Air blown into the mouthpiece flows through the inlet into the chamber and then takes a circuitous route to the windway. Excess moisture condenses in droplet form on the inside surfaces of the mouthpiece. The droplets collect in the bottom of the chamber with the result that substantially moisture-reduced air passes along the windway to the mouthpiece outlet and onto the fipple and blockages in the windway are thus substantially alleviated. The moisture collected in the chamber does not interfere with the sound produced by the wind instrument and so does not reduce the sound quality. The moisture does not need to be removed as frequently and can be removed from or shaken out of the chamber at a time convenient to the player. Since clogging is substantially avoided this windway can be narrower than in a conventional instrument, thus creating desirable extra resistance, which is especially desirable for inexperienced players. Additional or alternative resistance can be provided by reducing the size of the entrance to the windway and/or the size of the inlet passage.

A barrier may advantageously be incorporated across the whole width of the mouthpiece to stop collected moisture from inadvertently flowing into the windway and/or extra surfaces such as fins may be located in the bottom of the chamber for inducing condensation of moisture.

The mouthpiece of this instrument can be used in any size of musical wind instrument and is especially suitable for use in recorders. The mouthpiece and/or body of the instrument may be made from wood, ivory, metal or any other solid material which can be shaped by hand or machine. The preferred material is plastics because it can be used in mass manufacturing recorders. The mouthpiece can be of the type which is permanently attached to an instrument or the detachable type. The mouthpiece may be such that the windway is integral with the end of the instrument.

Embodiments of the invention are described by way of example, with reference to the drawings, in which.

Figure 1:
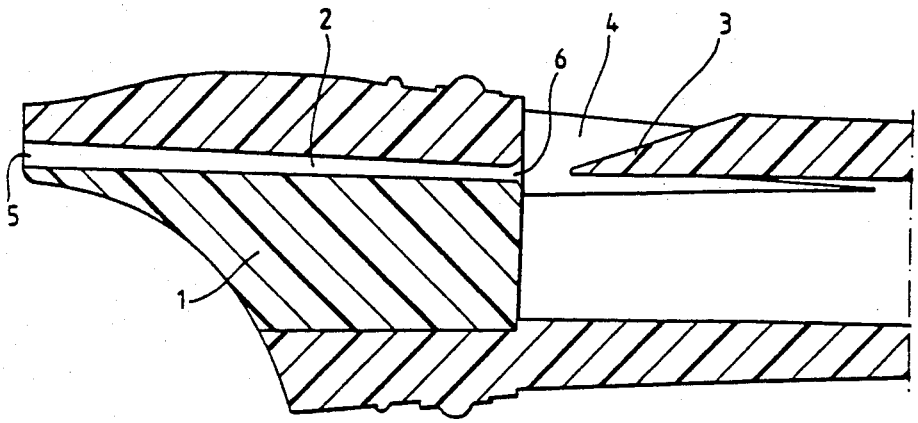
Fig.1. PRIOR ART
FIG. 1 shows a conventional recorder head in cross-section.
Figure 2:
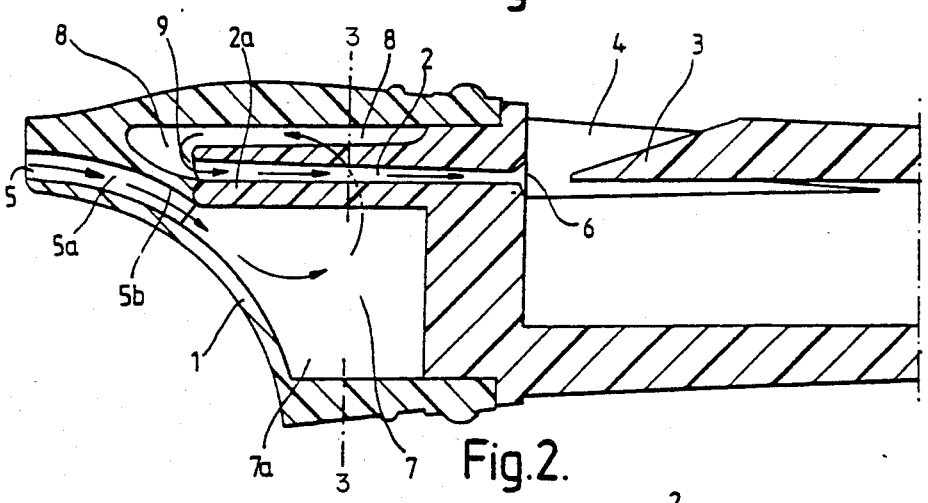
FIG. 2 shows a cross-sectional side view of a first embodiment of a mouthpiece according to the invention.
Figure 3:
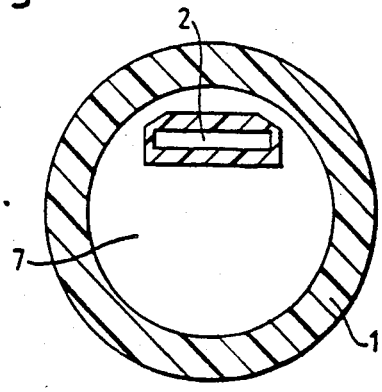
FIG. 3 shows a cross-sectional diagram of the embodiment of FIG. 2 taken through line 3—3 of FIG. 2.

A mouthpiece 1 has a hollow chamber 7 containing a straight-though windway 2 defined by a flat, rectangular tube, which extends from adjacent the inlet passage 5*a* to an outlet 6, as shown in FIG. 2. Features corresponding to those in FIG. 1 are referred to by the same reference numerals for clarity. The chamber 7 occupies a substantial part of the interior of the mouthpiece. The external walls of the mouthpiece are curved to retain their traditional shape but this is not necessary to the invention. The external walls surrounding the inlet passage 5*a* are slightly beaked for ease of blowing with the mouth.

Figure 4:
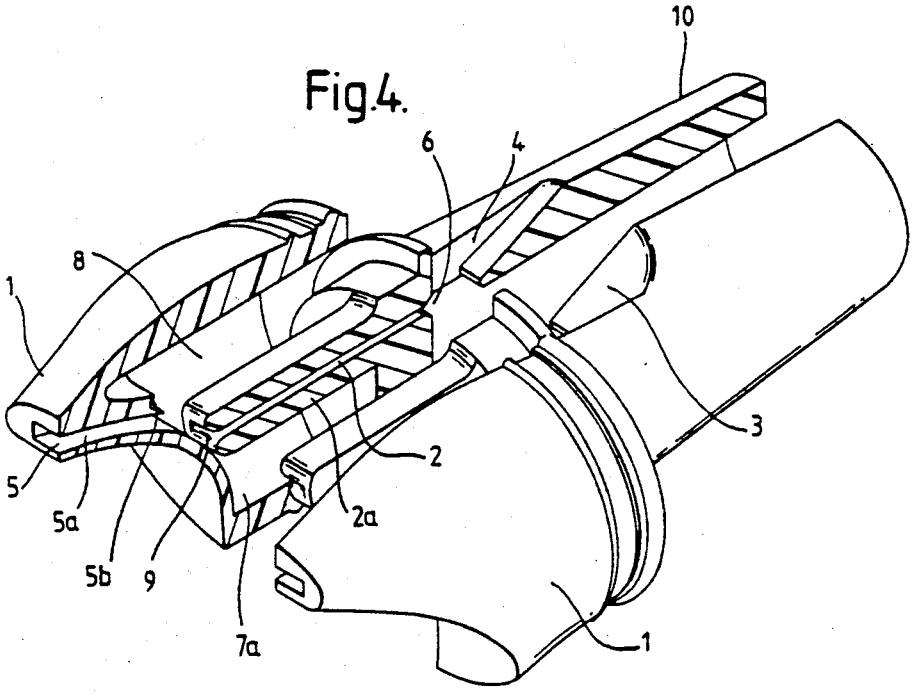
FIG. 4 shows a broken schematic perspective diagram of the mouthpiece of FIGS. 2 and 3.

The construction of this embodiment is clearly shown in FIG. 4, which is shown in two longitudinal halves (for the sake of illustration only). This embodiment can be conveniently manufactured as a two-piece plastics moulding comprising a mouthpiece cover 1 with the windway tube integral with the end of the recorder body 10. The entrance end of the bottom half 2*a* of the windway tube is shaped complementarily to the adjacent lip 5*b*, the lower surface of which forms part of the inlet passage 5*a* and the upper surface of which assists in guiding the air flow into the entrance 9 of the windway tube 2.

In playing, air is blown through the downwardly disposed inlet passage 5*a* into the bottom 7*a* of the chamber 7. The blown in air then follows a circuitous route via either or both sides of the windway to the space 8 at the top of the chamber and then to the entrance 9 to the windway 2. The air then passes through the windway in the conventional way.

Moisture in the warm intaken air condenses inside the chamber on the colder internal surfaces of the mouthpiece.

The condensation forms in droplets which collect in the bottom 7*a* of the chamber. The collected liquid can be subsequently removed or shaken out at convenient time and meanwhile does not interfere with the sound quality. The liquid can be shaken out through the inlet 5. Moreover, the sound quality is not diminished because blockage of the windway by liquid is substantially avoided.

Figure 5:
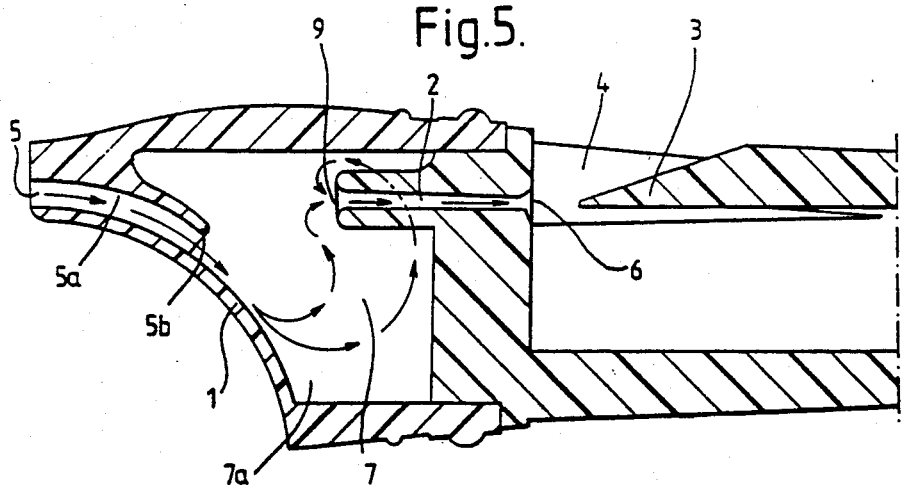
FIG. 5 shows a cross-sectional view of an alternative embodiment of a mouthpiece according to this invention.

In an alternative embodiment as shown in FIG. 5 the windway 2 is shorter than in the first embodiment and does not meet the end of the inlet passage 5*a*.

Each of these embodiments is especially suitable for a recorder moulded in plastics. Musical wind instruments according to the invention may be made from plastics, wood, ivory or other solid material which can be shaped by hand or machine, such as by moulding.

Mouthpieces according to this invention prevent sound disturbance because of collected moisture and can be used for a considerable time before cleaning out becomes necessary. This can be up to several hours and will vary from player to player. Since clogging of the windway of the mouthpiece is substantially avoided, the flow can be constricted which reduces the likelihood of overblowing by inexperienced players.

We claim:

1. A mouthpiece for a musical wind instrument, the mouthpiece comprising an inlet, an outlet, an enclosed windway formed by a tube which has a tube inlet and a tube outlet constituting the outlet of the mouthpiece, and a hollow chamber surrounding the tube for collecting liquid from inlet air, the inlet of the mouthpiece leading into the hollow chamber and the tube inlet being in communication with the hollow chamber.

2. A mouthpiece as claimed in claim 1, wherein the instrument comprises a recorder.

3. A mouthpiece as claimed in claim 1, wherein an inclined inlet passage is disposed between the inlet of the mouthpiece and the hollow chamber.

4. A mouthpiece as claimed in claim 1, wherein the windway is of rectangular cross section.

5. A mouthpiece as claimed in claim 4, wherein the windway includes an entrance end and a bottom half and wherein the entrance end of the bottom half of the windway is shaped complementary to an adjacent end of the inlet passage so that they fit together.

6. A mouthpiece as claimed in claim 1, wherein the windway is attached to the body of the instrument.

7. A mouthpiece as claimed in claim 6, wherein the windway tube extends along less than the whole length of the mouthpiece from the mouthpiece outlet to the mouthpiece inlet.

* * * * *